United States Patent [19]

Phillips et al.

[11] 4,141,594

[45] Feb. 27, 1979

[54] MANIPULABLE TOOL MOUNT

[75] Inventors: Reginald A. Phillips, Skelmersdale; John Eckersley; Terence Hamilton, both of Wigan, all of England

[73] Assignee: Gullick Dobson Limited, England

[21] Appl. No.: 803,910

[22] Filed: Jun. 6, 1977

[30] Foreign Application Priority Data

Jun. 8, 1976 [GB] United Kingdom ..... 23540/76
Jun. 8, 1976 [GB] United Kingdom ..... 23546/76
Jul. 8, 1976 [GB] United Kingdom ..... 28405/76

[51] Int. Cl.[2] ..... E21C 27/00
[52] U.S. Cl. ..... 299/43; 299/75
[58] Field of Search ..... 299/43, 51, 52, 42, 299/64, 71, 73, 74, 78, 75

[56] References Cited

U.S. PATENT DOCUMENTS

| | | | |
|---|---|---|---|
| 3,210,123 | 10/1965 | Delli-Gatti, Jr. | 299/71 |
| 3,469,885 | 9/1969 | Marberg | 299/71 |
| 3,746,104 | 7/1973 | McIntosh et al. | 299/70 |
| 3,915,501 | 10/1975 | Cobb | 173/43 |

FOREIGN PATENT DOCUMENTS

| | | | |
|---|---|---|---|
| 2425828 | 12/1975 | Fed. Rep. of Germany | 299/42 |

*Primary Examiner*—Ernest R. Purser
*Assistant Examiner*—William F. Pate, III
*Attorney, Agent, or Firm*—William Anthony Drucker

[57] ABSTRACT

A mining machine having a mineral winning head mount including a plurality of links pivotted successively one to another and powered means for pivotting the successive links about their pivot axes and whereon said links and powered means allow the mineral winning head to be retracted at least partially into an angled configuration of the links.

22 Claims, 4 Drawing Figures

MANIPULABLE TOOL MOUNT

The invention relates to mining systems utilising a selective mining machine including a mineral winning head that is manipulable relative to a body of the machine.

In our co-filed application No. 23538/76 a stope mining system with obliquely angled and/or inclined conveyor sections extending from strike gulleys, has a substantially continuous face conveyor extending across one or more strike gulleys at lower levels than adjacent face or stope sections, so that one or more mining machines can be used to form the gulleys as well as to remove material from the face sections. This introduces requirements for a high degree of permitted mining head working movement, say for working in a stope headroom of 1 meter and to form gulleys extending 1 meter below the floor of said stope, and it is an object of this invention to provide a suitable mounting.

According to the invention there is provided a mining machine having a mount incorporating powered means for pivoting successive legs of a mount linkage, preferably about substantially parallel axes, such that a mineral winning head can be retracted at least partially within the links. Preferably, the powered means comprises rams each disposed to effect rotation of the linkage about a different one of the axes.

A particularly compact arrangement using three legs results if, in their fully retracted states, the corresponding three rams produce a substantially U-shape of the linkage with the mining head disposed within the U.

Preferably, at one end, a machine body has a pivotal mount with a nominally vertical axis (i.e. relative to the machine body) from which a first mounting link extends for rotation by a first ram acting between the machine body and the first link. In the fully retracted position of this first ram the first link advantageously extends substantially at right angles and rearwardly of the machine body.

At its other end the first link has a nominally vertical pivotal mount for a second link with a second ram acting between the first and second links. In its full retracted state, this second ram conveniently causes the second mounting link to extend at right angles to the first link and away from the mining machine body. At its other end the second link has a further pivotal mount with a nominally vertical axis of rotation and carries thereat a head carrying link with a third pivotally connected ram acting between the second link and the head carrying link. In the fully retracted state of the third ram the head carrying link extends substantially parallel with the first link and, itself, serves as a mount for a mining winning head to lie within the U-shape of the three links with all three rams fully retracted.

In an alternative embodiment, a first link of substantially L-shape has one leg pivotted to a part of a machine body and its other leg pivotted to a head-carrying link. Preferably a first ram is mounted to act between the body part and the first link to rotate the latter about its pivotal mount to the body part, say acting at or near an end of the first leg extending beyond the pivotal mount to the body part.

A second ram is conveniently mounted to act between the first link and the head carrying link, say substantially parallel with the second leg.

A high degree of manipulability results if the mount linkage as a whole is rotatable relative to the machine body about a nominally horizontal axis, to allow cutting of gulleys and corners of face sections, particularly where the head is slidably substantially axially of the third link.

Accordingly said body part may comprise an axially extendable and rotatable boom to which the first link is pivotally mounted. Preferably said boom extends in direction which, in operation is substantially parallel with the mining face to be worked.

Preferably, a part of the mount, specifically at the head carrying link, is motorised for rotation of the head about an axis substantially perpendicular to the head carrying link and nominally horizontal.

In a further embodiment using a two link mount, the first link may have a slow and/or double transition to conform as closely as possible with a mining head on retraction thereof. The head itself, being preferably rotatable in its carrying link, may conveniently be mounted by way of reduction gearing within a bearing part of that link, preferably powered by a pressure-fluid-operated motor mounted directly to said bearing.

Embodiments of the invention will now be described, by way of example, with reference to the accompanying drawings, in which.

Figure 1:
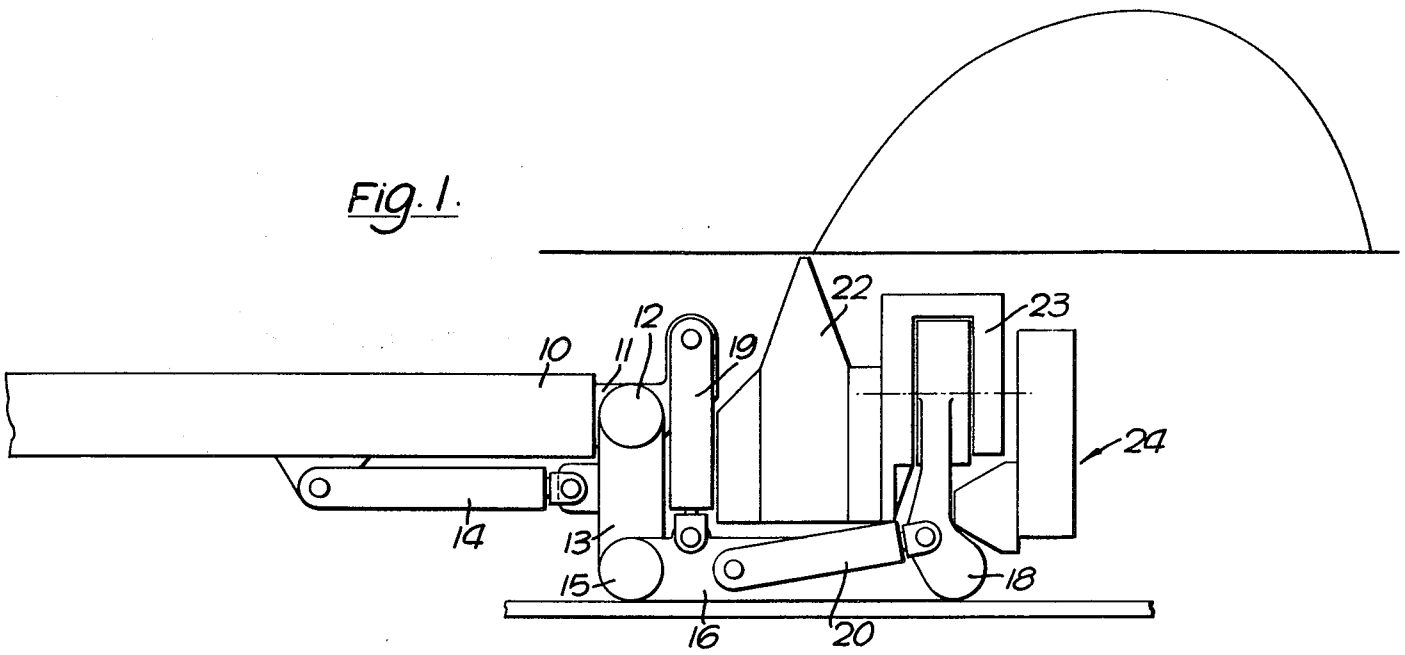
FIG. 1 is a diagrammatic plan view of one mining head mount.

In FIG. 1, a mining machine body 10 is mounted by parts not shown to extend parallel with the mining face and be translatable therealong via guide means associated with a face conveyor underlying the machine. Normally the machine body 10 (not fully shown) will include upwardly and downwardly directed staking means which are operated for a mineral winning operation so as to fix the machine between the floor and the roof of the working or, at a strike gulley, between a beam and the roof of the working.

At its relatively rearward end, the machine body 10 has an extension 11 carrying a pivotal mount 12 having a nominally vertical axis and serving to mount the first mounting link or leg 13 shown as extending generally rearwardly of the face. A first ram 14 is shown pivotally connected at its ends to, on the one hand, the machine body 10 and, on the other hand, to the link 13. In its fully retracted state the ram 14 pulls the link 13 generally perpendicular to the mining face.

At its other end, the link 13 carries a pivotal mount 15 also of nominally vertical axis. A second mounting link 16 is engaged by this pivotal mount 16 and has at its other end a third pivotal mount of nominally vertical axis and to which a third mounting link 18 is connected.

The second ram 19 is shown pivotally connected at its ends to a face-ward extension of the part 11 and to the second link 16. In its fully retracted position the ram 19 holds the second link 16 substantially at right angles to the first link 13 and extending away from the machine body substantially parallel with the mining face. A third ram 20 is shown pivotally connected at its ends between the second link 16 and the first link 18. In its fully retracted state, the third ram 20 holds the third link substantially at right angles to and extending face-ward of the second link 16, i.e. substantially parallel with the first link 13.

The first ram 14 is entirely outside the generally U-shape formed by the mounting link 13, 16 and 18 with the rams in their fully retracted state. The second and third rams 19 and 20 are positioned parallel or nearly parallel with the first and second links, respectively, and do not significantly intrude cross-wise of the space between the links. This space thus usefully accommodates a mining head 22 mounted on the third link 18, preferably for pivotable movement on a bearing 23 thereof by the action of a motorised drive indicated generally at 24.

Appropriate control of the interaction of the extension of the three rams, rotation of the mineral winning head itself, and rotation of the entire mount linkage allows a satisfactory cutting profile to be achieved both for the face itself and for cutting a gulley below the level of the machine as required in a stope mining system with lower strike gulleys.

Figure 2:
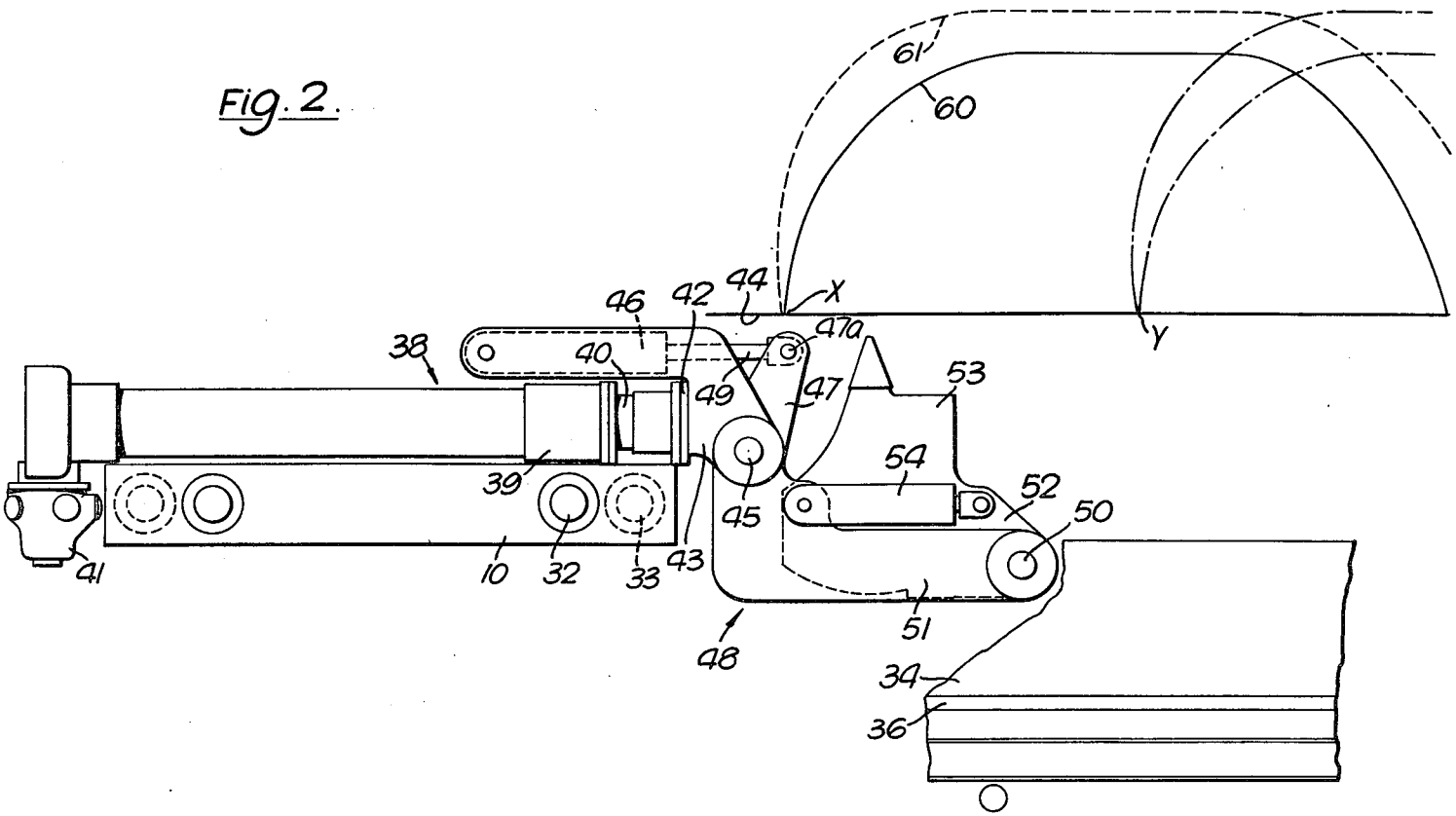
FIG. 2 is a diagrammatic plan view of another mining head mount.
Figure 3:
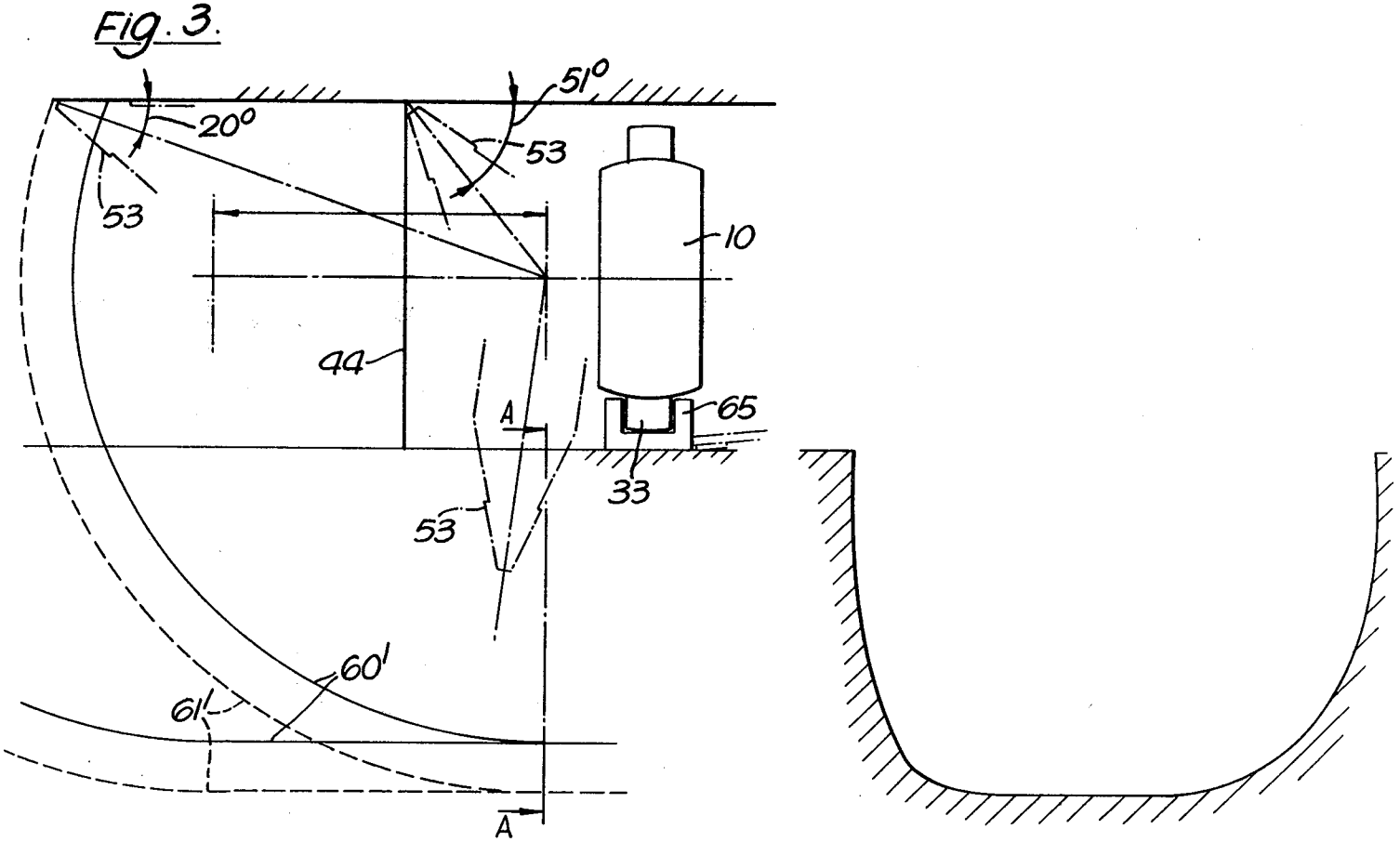
FIG. 3 is an outline section through a mining face at a strike gulley, specifically in relation to FIG. 2.

In FIGS. 2 and 3, the mining machine body 10 is shown with upwardly and downwardly acting staking rams 32 and 33, respectively at each end thereof for securely locating the machine body during a mineral winning operation. The machine body 10 is attached by parts not shown (but see the following description of FIG. 4 for a possible scheme) to be movable relative to a face conveyor 34, preferably along a guide means 36.

Extending parallel to the machine body 10, and on the mineral face side thereof, is a boom 38 shown as comprising a cylinder 39 fixed to the machine body 10 and an extendible piston 40 coaxial therewith. A pressure-fluid-operated motor is indicated generally at 41 along with pressure-fluid receiving and distributing means for, respectively, rotating and extending the boom piston 40 from one end of the boom.

At its other end 42 the boom piston 40 has an extension 43 that extends to a pivot mount 45 spaced further from a mineral face 44 and also returns substantially parallel with the boom on the other side of the boom axis to serve as a mount for a first pressure-fluid ram 46. The pivotal mount 45 carris, at an intermediate position therealong, one leg 47 of a generally L-shaped member 48. The free end of this leg 47 is pivotally connected at 47a to piston 49 of the first ram 46. As can be seen from the drawing, this leg 47 is angled away from the boom 38 where it extends beyond the pivotal mounting 45.

The L-shaped member 48 has a pivotal mounting 50 at the end of its other leg 51. The pivotal mounting 50 has an axis parallel to that of the pivotal mounting 45 to serve in attaching a further member 52 on which a mineral winning head 53 is mounted, preferably in a slide. A second ram 54 is pivotally mounted at each end to act between the L-shaped member 48 and the further member 52 with, at full retraction, the further member 52 substantially underlying and parallel with the leg 51, together with the second ram 54.

In the position shown in the drawing, leg 51 of the L-shaped member 48 is substantially parallel with the axis of the boom and the first ram is extended. The mineral winning head, assumed to be of the impact-type, is shown directly facing and substantially perpendicular to the mining face to be worked and lying substantially entirely with the angle between the legs of the L-shaped member. Extension of the second ram 54 and retraction of the first ram 45 will bring the mineral winning head into the face to be mined with a good angle of attack even after removal of a substantial depth of material as shown by the full and dotted lines 60 and 61 relating to maximum cutting profiles without and with a crowd, respectively.

Extension of the boom piston 40 allows working to start at the position X and continue to the position Y so that the full cutting profiles indicated can be realised, particularly utilising rotation of the boom.

Rotation of the boom combined with the action of the two rams also allows the mineral winning head to operate at levels below the machine as indicated in outline in FIG. 3, which is a section through a mining face or stope working at the position of a gulley below the level G of the stope itself. A beam 65 is shown carrying the machine body via its downwardly directed staking rams, and this beam extends across the gulley, preferably on a bridging section between conveyor sections associated with mining face or stope sections between strike gulleys.

The mineral winning head 53 itself is preferably mounted for rotation at least in an axis parallel to that of the beam in the position indicated in FIGS. 2.

The height of the mount as a whole above the floor of the face working may be adjusted by varying the relative extensions of upwardly and downwardly acting staking rams for the mining machine as a whole. A similar effect for the mount alone may be achieved by upwardly and downwardly acting rams operative to position the head mount between upper and lower mounting beams or frame parts fixed to the machine body, typically on the face side thereof. Such arrangements may of course both be present to allow further flexibility of operation. Such upwardly and downwardly acting rams also allow tipping of the machine body and/or the head mount to different angular positions relative to the floor of the working.

The mineral winning head is preferably slidably mounted on a base fixedly attached to the final mount link so as to allow the head to be moved into the mineral face as a "crowding action".

Figure 4:
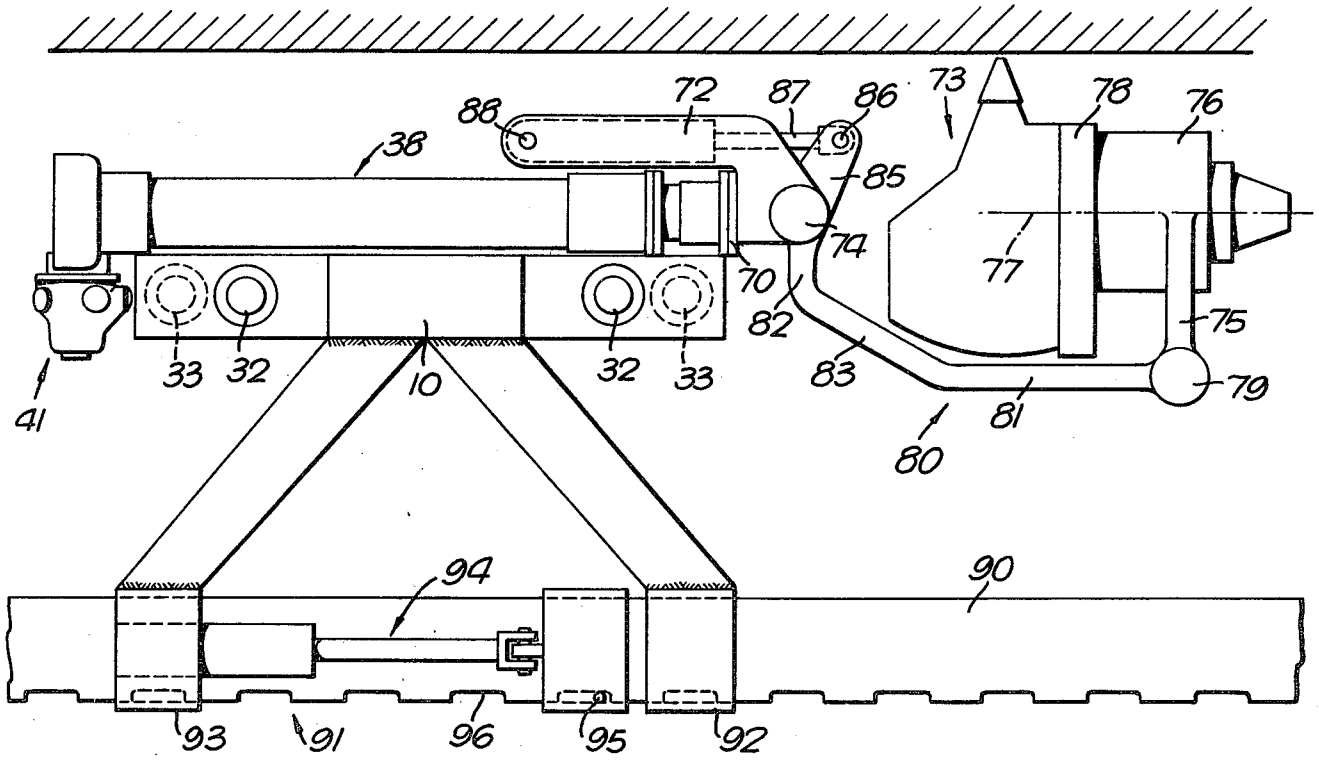
FIG. 4 is a diagrammatic plan view of a mining machine and its traversing mechanism, also showing another mining head mount.

In a generally similar manner to FIG. 2, FIG. 4 shows a stakable mining machine frame 10 with an axially extendable and rotatable boom 38 having a head 70 which is rigidly mounted a bracket 72 extending, in the position shown, firstly towards the face and then parallel and close to the boom 38 rearwardly of the boom head 70. This bracket 72 is shown pivotally mounted at 74 to a mineral winning head mount.

The mineral winning head mount comprises a first arm 75 that is shown as being substantially straight and pointing towards the face, and has a bearing head 76 within which suitable transmission gearing is mounted for rotational movement about an axis 77 that is transverse, specifically perpendicular, to the general direction of the arm 75. The bearing head 76 rotatably supports an impact type selective mining head 73 by way of a slide mechanism 78 that has a sliding direction generally parallel with the arm 75 to allow the mineral winning head 77 to be moved further towards the face from the position shown in the drawing. A pressure-fluid-operated motor 78 is indicated on the outboard side of the bearing head 76 for achieving rotation of the mineral winning head and slide structure 77, 78.

The arm 75 is shown as being pivotally supported at 79 by a second arm 80 having a first substantially straight end part 81 shown as extending from the pivot 79 substantially at rightangles to the arm 75, a shorter second end part 82 substantially at right angles to the first part 81 and an intermediate part 83 affording a space saving slow, double transition between those two perpendicular end parts 81 and 83. The end of the part 82 is shown as being pivotally supported by the bracket 72 at the pivot mount 74. The axes of the pivots 74 and 79 are shown as being substantially parallel to allow movement of the mineral winning head 77 in the same plane.

The end part 82 of the second arm 80 is shown as having a face-ward extension 85 with a pivotal connection 86 for one end of a pressure-fluid-operated ram 87 coupled at its other end by a pivot 88 to the bracket 72 so that extension and retraction thereof produces rotation of the second arm 80 about the pivot 74. A pressure-fluid-operated ram (not shown) will also be provided with pivotal attachments to the arm 80 and the arm 75 to produce pivotal movement of the arm 75 about the pivot 79. Such a ram would normally be mounted below the arm 80 as viewed in FIG. 4 and acting between brackets or extensions of the arms 75 and 80, and would be difficult to illustrate in the plan view of the Figure with the mount in the angular position shown relative to the boom 16.

As can be seen from the drawing, the overall arrangement of the mineral winning head and its mount is particularly compact in the position illustrated and yet the head is, by rotation about either or both of the pivots 74 and 79 and movement in the slide 78 capable of substantial adjustment of the angle of attack of a chisel or other impace tool in the head 77. The further provision for rotation of the head within the bearing 76 of the arm 75 and also for rotation and extension of the boom head 70, and thus the head mount as a whole, allows for very substantial adjustment of the head 77 both perpendicular to the plane of the drawing and as to its spacing from the machine body 10. This enables not only the selective removal of material from the face but also the digging of a gulley below the general floor level of the face working itself, and for operation above or from one side of such a gulley.

The drawing also indicates a mining machine guide rail 90 and a mining machine guiding structure 91 which basically comprises a pair of spaced rail engaging shoes 92 and 93 that it is to be understood are secured relative to the mining machine body 10 so as to guide the mining machine as a whole in its movement along the guide rail 90. A double beam type interconnection of the guiding structure 91 and the machine body 10 is specifically shown and this lends itself to a particularly convenient arrangement where one beam is rigidly secured and the other is pivotally mounted. Although shown as being substantially in register with the machine body 10, the guiding structure may be advantageously located opposite and substantially centred relative to the overall centre of gravity of the machine body 10 and the mineral winning head/mount combination.

The leading shoe 93 is shown as securely mounting a pressure-fluid-operated ram 94, specifically the cylinder thereof, operative between the shoe 93 and a guide rail engaging mechanism 95. Utilising such a facility, the mining machine is self-propelling and the guide rail 90 is specifically shown as being recessed 96 at regular intervals and the mechanism 95 preferably includes a ratchet type mechanism with a plunger or pawl arrangement that will slide over the racked edge of the guide rail when the ram 94 is contracted but will give positive engagement in a recess 96 on extension of the ram 94 so as to drive the mining machine bodily from right to left of the drawing. Additionally or alternatively, of course, a drive mechanism may be provided that will operate in either direction along the guide rail 90. During such movement, at least the roofengaging staker rams will be released so that the machine body 10 is free to move. It may be preferred also to release the downwardly directed staker rams.

The machine guide rail 90 is shown in a preferred spaced relation relative to the mining machine body and may be integral with a face conveyor system of which a material receiving surface extends from the guide rail 90 towards the face and preferably underneath the mining machine body 10, which may ride on that surface or, during mining machine movement, may rest on an additional guide.

It will be realised that other forms of positive engagement with a guide rail of which that referenced 90 is merely one example, by a self-propelling mechanism of the mining machine may be used, such as notched wheel or work-type drives for continuous or indexed movement.

The various pressure-fluid-operated rams and motors are preferably of hydraulic type but may, if desired, be pneumatically operated and, where safety regulations permit, other types of rams and/or motors say electric, may be used.

Also the specifically shown relative positions of the boom 16 and the machine body 10, and of the bracket 22 and the boom 16 and/or the machine body 10, may be varied as desired for a particular installation.

We claim:

1. A traversable mining machine having mount for a mineral winning head at an end part of the mining machine with respect to its direction of traverse, the mount including a plurality of links pivoted successively one to another and powered means for pivoting the successive links about their pivot axes in extending and manipulating the head for cutting at least to one side of the mchine in its traverse direction, and wherein said links and powered means also allow the mineral winning head to be retracted so that at least a main body of the head lies in an angled configuration of the links behind an end of the first of the links that is to said one side and alongside the first link and the next link pivoted thereto, and the overall link and head body structure within the confines of the machine sideways of the traverse direction.

2. A mining machine according to claim 1, wherein the powered means comprise pressure fluid operated rams.

3. A mining machine according to claim 2, wherein the rams are hydraulic.

4. A mining machine according to claim 1, wherein said links and the powered means allow the mineral winning head to be retracted into a substantially U-configuration of the links closely embracing the head therewithin.

5. A mining machine according to claim 4, having three said links.

6. A mining machine according to claim 5, wherein a part of a frame of the traversable mining machine carrying a pivotal mount also has a ram connected between that said part and the first link for pivoting from a retracted position wherein the link extends at right angles to the traversing direction.

7. A mining machine according to claim 6, wherein the first link has a pivotal mount for a second said link, and a ram is connected to act between the first and second links for pivotting from a position wherein the second link is substantially alinged with the traversing direction and extends away from the frame part.

8. A mining machine according to claim 7, wherein the second link has a pivotal mount for a head carrying link, and a ram is connected to act between the second and head carrying links for pivotting from a position wherein the head carrying links is substantially at right angles to the second link and extends in the same direction as the first links.

9. A mining machine according to claim 1, wherein a first link of pronounced substantially L-shape has one leg pivoted to a part of a frame of the mining machine and its other leg pivoted to a head-carrying link.

10. A mining machine according to claim 9, wherein said one leg extends beyond its pivotal mounting to the frame part.

11. A mining machine according to claim 9, wherein a first ram is mounted to act between the frame part and the first link to rotate the latter about is pivotal mount to the frame part.

12. A mining machine according to claim 11, wherein a second ram is mounted to act between the first link and the head carrying link.

13. A mining machine according to claim 12, wherein the second ram acts substantially parallel with said second leg.

14. A mining machine according to claim 8, wherein the head is slidably mounted for powered movement axially of the head carrying link.

15. A mining machine according to claim 14, wherein the head or a slide mount therefor is drivingly rotatable about an axis extending at right angles to the head carrying link and towards the machine frame in the retracted position of the head.

16. A mining machine according to claim 15, comprising a hydraulic piston and cylinder arrangement for the head sliding, and a hydraulic motor for the head rotation.

17. A mining machine according to claim 6, wherein said frame part is rotatable relative to the machine main frame about an axis parallel to the traversing direction.

18. A mining machine according to claim 17, wherein said frame part comprises an axially extendable and rotatable boom to which the first link is pivotally mounted.

19. A mining machine according to claim 18, wherein said boom extends in direction which, in operation is substantially parallel, with the mining face to be worked.

20. A mining machine according to claim 1, wherein a head carrying link is pivotted to a frame part pivotted link that has slow or double transition form to snugly receive said head.

21. A mining machine according to claim 6, wherein the frame is coupled to a traversing mechanism operative relative to a guide spaced from the head mount at the other side of the frame in the traverse direction.

22. A mining machine according to claim 21, wherein the traversing mchanism is self propelling and the guide is integral with a conveyor.

* * * * *